US005953023A

United States Patent [19]

Shimomura et al.

[11] Patent Number: 5,953,023

[45] **Date of Patent: *Sep. 14, 1999**

[54] INK JET HEAD AND INK JET APPARATUS PROVIDED WITH SAID INK JET HEAD

[75] Inventors: Akihiko Shimomura, Yokohama; Shigeo Toganoh, Tokyo; Kunihiko Maeoka, Kawasaki; Kenji Aono, Kokubunji, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/436,371

[22] PCT Filed: Sep. 29, 1994

[86] PCT No.: PCT/JP94/01616

§ 371 Date: Sep. 22, 1995

§ 102(e) Date: Sep. 22, 1995

[87] PCT Pub. No.: WO95/09085

PCT Pub. Date: Apr. 6, 1995

[30] Foreign Application Priority Data

Sep. 29, 1993 [JP] Japan ..... 5-242581

[51] Int. Cl.[6] ..... B41J 2/175

[52] U.S. Cl. ..... 347/20; 347/85

[58] Field of Search ..... 347/20, 85, 86, 347/87

[56] References Cited

U.S. PATENT DOCUMENTS

Re. 32,572 1/1988 Hawkins et al. ..... 347/20

FOREIGN PATENT DOCUMENTS 5-001257A2 1/1993 Japan .

*Primary Examiner*—Valerie Lund

*Attorney, Agent, or Firm*—Fitzpatrick, Cella, Harper & Scinto

[57] ABSTRACT

An ink jet head, characterized by having a sealing member formed of a composition comprising a solvent-free one-component silicone-modified epoxy resin in the liquid state at room temperature as a principal component, said composition containing, other than said silicone-modified epoxy resin, a latent hardener, wherein said silicone-modified epoxy resin comprises a silicone component in an amount of 10 to 60 parts by weight versus 100 parts by weight of a starting epoxy resin. And ink jet apparatus which is provided with said ink jet head and a recovery means for said ink jet head. The ink jet head always performs stable ink discharging to provide a high quality print.

22 Claims, 5 Drawing Sheets

INK JET HEAD AND INK JET APPARATUS PROVIDED WITH SAID INK JET HEAD

FIELD OF THE INVENTION

The present invention relates to an ink jet head and an ink jet apparatus provided with said ink jet head. More particularly, the present invention relates to an ink jet head provided with a sealing member comprised of a specific silicone-modified epoxy resin at a joint portion for the constituent members of the ink supply passages and an ink jet apparatus provided with said ink jet head.

RELATED BACKGROUND ART

For the conventional ink jet head, there is a problem in that ink to be discharged to a printing medium has an occasion of leaking through a joint portion for the members constituting the ink supply passages from the ink container through the discharging outlets, wherein such leaked ink sometimes results in providing a stain onto a print product obtained. In addition, there is also a problem in that when an air bubble should present in the ink pathway, such air bubble is liable to cause a reduction in the energy dedicated for discharging ink, wherein the reduction will make it unable to conduct normal ink discharging. In view of this, in order to prevent the occurrence of such ink leakage and also in order to prevent such air bubble from entering into the ink pathway, there is a proposal in that a sealing material is disposed in the ink jet head or the joint portion of the constituent members for the ink supply passages of the ink jet head.

An example of a known ink jet head provided with such sealing member and an example of a known ink jet apparatus provided with such ink jet head are schematically shown in FIGS. 1 to 4.

FIG. 1 is a schematic slant view illustrating an example of the known ink jet head. FIG. 2 is a schematic cross-sectional view illustrating a cross section of a principal portion, namely a A-B cross-sectional portion, taken along the ink pathway of the ink jet head shown in FIG. 1 and which was viewed in a direction indicated by arrow marks in FIG. 1.

FIG. 3 is a schematic explanatory view of a discharging element portion of the ink jet head shown in FIG. 1. FIG. 4 is a schematic view illustrating an example of an ink jet apparatus provided with the ink jet head shown in FIG. 1.

In FIG. 1, reference numeral 1 indicates an ink jet head. To the ink jet head 1, there is connected an ink supply unit 2 for supplying ink. The ink supply unit 2 is connected to an ink tank 5 through ink supply tubes 3. The ink tank 5 comprises an ink container 5B containing black ink therein and a three-chambered ink container 5C containing yellow ink, magenta ink and cyan ink which are arranged respectively on an opposite side of an aluminum base plate 4 for the ink jet head. Each of these ink containers is provided with an insertion hole into which the ink supply tube 3 can be inserted so that the ink containers can be detachably connected to the ink supply unit 2.

The ink jet head 1 has such constitutions as shown in FIG. 2 and FIG. 3, wherein the ink jet head comprises an electrothermal converting body comprising a heat generating element 103 and wirings 102 for said heat generating element formed by means of the conventional thin film-forming technique on a silicon wafer base member 101. On the silicon wafer base member having said electrothermal converting body formed thereon, there is disposed an ink pathway wall 104 having ink pathway-forming walls 104*a* and a common ink chamber-forming wall 104*b* formed by a resin such as a photosensitive resin. Reference numeral 105 indicates a top plate made of glass which is joined so as to cover recesses formed by the ink pathway wall 104 thereby establishing ink pathways and a common ink chamber. The top plate 105 is provided with an opening as a common ink supply port 107. The common ink supply port 107 is covered by a filter 106 for ink. The top plate 105 is provided with a sealing member 110 formed by means of a dispenser or by the screen printing process. The ink supply unit 2 is connected to the common ink supply port through the sealing member 110.

FIG. 4 is a schematic explanatory view of an example of an ink jet apparatus (IJA) provided with an ink jet head cartridge (IJC) comprising the ink jet head shown in FIG. 1.

In FIG. 4, reference numeral 20 indicates an ink jet head cartridge (IJC) provided with a plurality of ink discharging outlets opposite the recording face of a printing sheet transported on a platen 24. Reference numeral 16 indicates a carriage HC for holding the IJC 20 thereon. The carriage is connected to part of a driving belt 18 which serves to transmit a driving force from a driving motor 17, and it is designed such that it can be moved while sliding on a pair of guide shafts 19A and 19B being arranged in parallel with each other. By this, the IJC 20 is made capable of moving back and forth along the entire width of the printing sheet.

Reference numeral 26 indicates a recovery device which is disposed at a predetermined position within the range in which the IJC 20 is moved, specifically, for example, at a position opposite the home position. The recovery device performs capping to the discharging outlets of the IJC 20 by a driving force through a driving mechanism 23 from a motor 22. Further, the discharging outlets of the IJC can be protected by way of capping by means of the recovery device when the printing is terminated.

Reference numeral 30 indicates a blade made of silicone rubber serving as a wiping member which is disposed at a side of the recovery device 26. The blade 30 is held at a blade holding member 30A in the form of a cantilever, and it is operated, as well as in the case of the recovery device 26, by means of the motor 22 and the driving mechanism 23 so as to encounter the outlet face of the IJC. By this, the blade 30 is projected in the range in which the IJC 20 is moved on appropriate timing during the printing operation by the IJC 20 or after recovery treatment by using the recovery device, whereby dew drops, moisture, dusts or the like adhered on the outlet face of the IJC 20 can be swabbed.

As above described, the sealing member is disposed at a position of the ink jet head which is contacted with ink. Because of this, when a coating composition for the formation of the sealing member is applied in an excessive amount, there is an occasion for the sealing member formed to be partly invaded into the ink pathways, wherein such invasion into the ink pathways entails a problem in that some of the discharging outlets are clogged in the worst case. In order that the amount of the coating composition for the formation of the sealing member can be precisely controlled so that the sealing material is not invaded into the ink pathways, there is usually used a coating composition in the liquid state at room temperature.

Particularly, there is used a solvent-free coating material in the liquid state at room temperature. The reason why the formation of the sealing member is conducted using such solvent-free coating material is due to the following points. That is, since the sealing member is disposed such that it unavoidably contacts with ink, when the sealing member contains a solvent, the solvent is liable to elute into the ink thereby modifying the chemical composition of the ink, wherein there will be sometimes occurred a problem in that the ink is not efficiently discharged as desired. Further, the sealing member is disposed at a portion where the constituent members of the ink supply passages are joined, and because of this, the formation of the sealing member is necessary to be conducted while having a due care so that any negative influence is provided for the precision of an ink jet head assembled. Hence, it is desired for the sealing member to be formed by using a one-component coating material having a long working life and which is substantially free from a necessity of having a due care about its working life. Other than these, from the viewpoints in terms of the functional requirements for an ink jet head, the sealing member is required to be sufficient in air tightness and fluid tightness as above described and in addition, it is also required to be low in stress and high in resistance to ink.

Particularly, for instance, in the case of an ink jet head in which the ink passage wall as a constituent thereof is constituted by a material having a large thermal expansion coefficient, the sealing member situated in the vicinity of the discharging element is liable to suffer from a stress caused by a thermal expansion of said material, wherein the sealing member will be sometimes removed. In order to prevent occurrence of the removal problem, it is known that the sealing member is designed to possess an elasticity capable of absorbing such stress. This elasticity effectively works also against an impact which the ink jet head will have upon conducting recovery treatment and the like, specifically, for example, upon conducting wiping treatment.

Further, since the position where the sealing member is disposed is to be directly contacted with ink as above described, the sealing member is required that it is highly resistant against the ink, namely, hardly deteriorated in terms of the function with the ink, and it does not provide an eluate of imparting a negative influence to the ink.

Thus, it is understood that the sealing member disposed in an ink jet head is required to totally satisfy the above described requirements therefor and to exhibit sufficient sealing properties.

In the above described viewpoints, it is known to use a silicone rubber sealant as the sealing member for an ink jet head.

Now, in the case where an air bubble accidentally enters into the common ink chamber or ink passage of an ink jet head, the ink jet head is subjected to recovery treatment using a recovery mechanism including, for example, a suction pump capable of being operated by means of a timer disposed at the apparatus body and in a manually operating manner. In this case, when the air bubble stays on the upper stream side to the energy generating body in the direction for ink to be supplied, in order to remove the air bubble, the recovery treatment is necessary to be conducted by virtue of a remarkable suction force.

By the way, in order to comply with an increased demand for miniaturization of an ink jet apparatus in recent years, there is a tendency for the ink container therefor to be small in terms of the capacity accordingly. This tendency is more apparent as for a cartridge type ink jet apparatus in which an ink container is mounted on a carriage. In the case where the ink container is thus made to be small in terms of the capacity, it is desired to use ink only for the purpose of conducting printing but not for other purposes, wherein the foregoing recovery treatment is desired to be conducted as little as possible.

As the cause for such air bubble to enter into the ink jet head, there are considered a case wherein an air bubble is contaminated during the production of an ink jet head and other case wherein air contained in ink in a dissolved state is released to provide an air bubble due to a temperature rise upon ink discharging. The problem relating to contamination of such air bubble during the use of an ink jet head may be eliminated by subjecting the ink jet head to recovery treatment before its shipment.

However, in the case where the ink jet head having been subjected to recovery treatment is maintained in a non-use state over a long period of time, there will be an occasion when an air bubble is generated within the ink jet head. The generation of such air bubble is usually caused chiefly due to the invasion of air through a sealing member used for sealing the joining portion of constituents for the ink supply passage. Particularly, the conventional silicone rubber sealant by which the sealing member is constituted is high in gas permeability and it is not problematic as long as the ink jet head is used in the ordinary manner, but when the ink jet head is maintained in a non-use state over a long period of time, a problem is liable to entail in that ink vaporizes little by little through the opening as the common ink supply port, wherein air invades through the joint portion in an airtight state by means of the silicone rubber sealant between the common ink supply port and the ink supply unit so as to supplement a pressure difference caused by the vaporization of the ink whereby generating an air bubble. In this case, it is necessary to conduct the foregoing recovery treatment.

In order to eliminate this disadvantage, it is considered to constitute the sealing member by an epoxy resin having an excellent gas barrier property. However, the epoxy resin is insufficient in flexibility in relation to the foregoing stress and because of this, a removal is liable to sometimes occur at the sealing member. Hence, the epoxy resin is not suitable to be used as the sealing member for an ink jet head.

Other than the above, it is considered to constitute the sealing member by an elastic epoxy resin obtained by modifying the epoxy resin so as to have an improved flexibility. However, although such elastic epoxy resin has a satisfactory gas barrier property and a satisfactory flexibility, it is poor in resistance to ink. Thus, the elastic epoxy resin is also not suitable to be used as the sealing member for an ink jet head.

In recent years, an ink jet apparatus has been using not only in the field of printers but also in other fields of copying apparatus and dyeing apparatus. Particularly, ink has been often depositing on OHP sheets, clothes and the like which are different from printing sheets such as papers, using an ink jet apparatus. And print products applied with an improved water proof has been often produced. In this case, highly alkaline ink is usually used in order to attain an improved fixing property and an improved water proof for the print products. Particularly, in order to obtain a print product with an improved fixing property and an improved water proof, ink comprising a dye having a relatively low solubility to a solvent and a pigment having a relatively low dispersibility is sometimes used. Said ink is usually made to be highly alkaline, wherein said dye is desirably solubilized and said pigment is desirably dispersed so that said dye and said pigment can be efficiently utilized.

Along with the use of such highly alkaline ink, there is a demand for attaining an improved ink resistance for the sealing member. In fact, when a conventional ink jet head with the use of highly alkaline ink having been used is allowed to stand without using over a long period of time, there is a tendency that the quantity of air bubbles contaminated into the ink passage is greater than that in the ordinary case and a removal is occurred at the sealing member of the ink jet head having been operated with the use of the highly alkaline ink. Further, in this case, if the ink jet head is of the type that the sealing member is disposed in the vicinity of electric wirings, there is a tendency that a short circuit is occurred between the electrodes.

SUMMARY OF THE INVENTION

A principal object of the present invention is to provide an improved ink jet head which is free of the foregoing problems found in the prior art and an ink jet apparatus provided with said ink jet head.

Another object of the present invention is to provide an ink jet head provided with an improved sealing member having an increased ink resistance in which the joint of the constituent members for the ink supply passage excels in fluid-tightness and airtightness and is stably maintained without occurrence of a removal even under environmental conditions having temperature changes, and an ink jet apparatus provided with said ink jet head.

A further object of the present invention is to provide an improved ink jet head in which the recovery treatment upon the generation of an air bubble in the prior art is not necessary to be conducted and which excels in use efficiency even in the case of using a small ink container, and an ink jet apparatus provided with said ink jet head.

A further object of the present invention is to provide a ink jet head provided with an improved sealing member which is free of generation of an air bubble and is free of occurrence of a removal at the sealing member even in the case of using highly alkaline ink, and an ink jet apparatus provided with said ink jet head.

A further object of the present invention is to provide an improved ink jet head which ensures the provision of a high quality print product even after having been allowed to stand without using over a long period of time, and an ink jet apparatus provided with said ink jet head.

The present invention has been accomplished as a result of extensive studies through experiments by the present inventors in order to solve the foregoing problems in the prior art and in order to attain the above objects.

That is, the present inventors made extensive studies of whether or not it is possible for an epoxy resin to realize an improved sealing material having an excellent function in terms of resistance to ink which is superior to that of the conventional sealing material when the foregoing problem concerning the stress is eliminated while making use of the excellent gas barrier property the epoxy resin. As a result, there was obtained findings that a sealing material composed of a specific silicone-modified epoxy resin and a latent hardener has an excellent airtight property, a property of causing a slight stress and a high ink resistance, and when said sealing material is used as a sealing member for the joint of the constituent members for ink supply passages of an ink jet head, the resulting ink jet head becomes such that ensures to continuously conduct stable ink discharging without causing a removal at the sealing member even in the case of not conducting recovery treatment or even after the ink jet head having been allowed to stand without using over a long period of time.

The above described objects of the present invention can be attained by using a solvent-free composition substantially comprised of an one-component silicone-modified epoxy resin in the liquid state at room temperature and a latent hardener (this composition will be occasionally referred to as silicone-modified epoxy resin composition in the following) as a sealing member. Particularly, the ink jet head according to the present invention is characterized by having a specific sealing member constituted by said silicone-modified epoxy resin composition.

The silicone-modified epoxy resin in the present invention comprises a silicone component in an amount of 10 to 60 parts by weight versus 100 parts by weight of a starting epoxy resin (specifically, 10 to 60 parts by weight of said silicone component added to 100 parts by weight of said starting epoxy resin).

The ink jet head having according to the present invention includes a configuration in which a state change is caused at ink by virtue of a thermal energy generated by an electrothermal converting body when an electric energy is applied thereto, whereby ink is discharged.

Further, the ink jet head according to the present invention includes a full-line type configuration having a plurality of discharging outlets arranged in accordance with the entire width of the printing area of a printing medium on which printing is to be performed.

Further in addition, the present invention includes an ink jet apparatus having a sealing member constituted by the above described silicone-modified epoxy resin composition.

The term "sealing member" in the present invention indicates a member which is used for the purposes of preventing a sealing portion of an ink jet head from being influenced by external things such as moisture, vibration, shock, and the like and facilitating electrical insulation and heat dissipation.

As above described, the sealing member in the present invention is formed of the foregoing silicone-modified epoxy resin composition (that is, substantially comprising the foregoing specific silicone-modified epoxy resin and a latent hardener). The silicone-modified epoxy resin composition may contain a filler such as silica, carbon black or the like, a thixotropic agent such as aerogel or the like, or a pigment, if necessary.

DESCRIPTION OF THE INVENTION AND THE PREFERRED EMBODIMENTS

Figure 1:
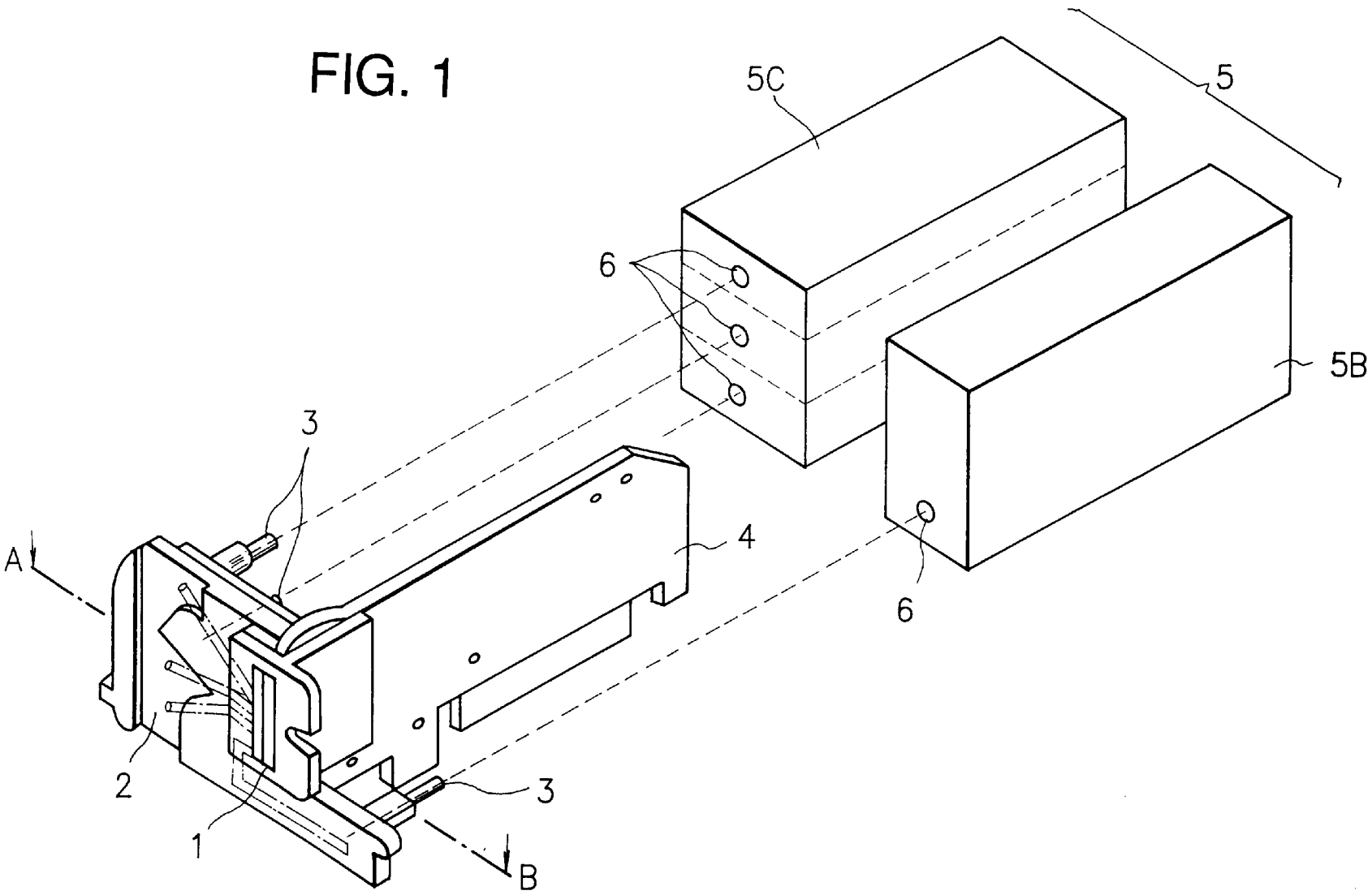
FIG. 1 is a schematic slant view illustrating an example of a conventional ink jet head.
Figure 2:
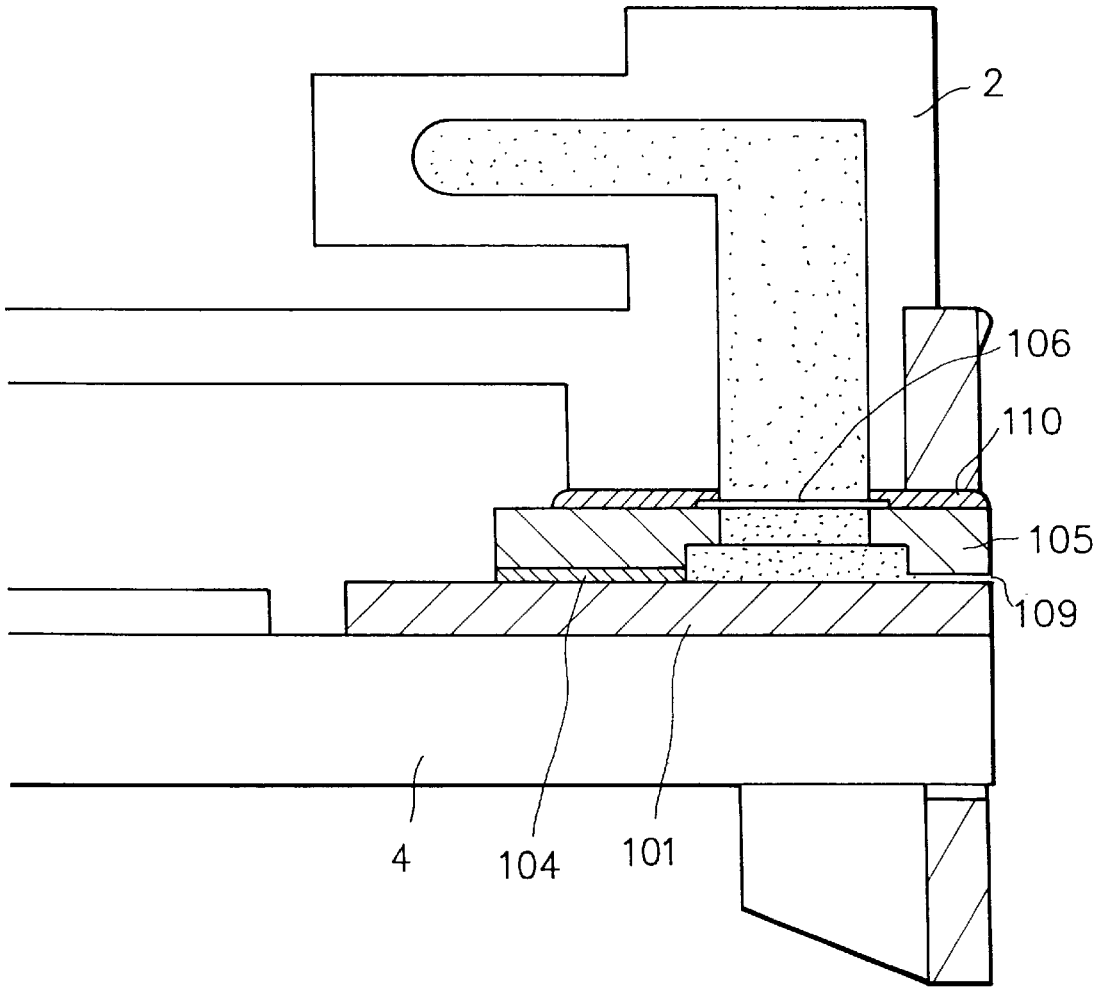
FIG. 2 is a schematic cross-sectional view of a principal portion of the ink jet head shown in FIG. 1 when viewed from a direction indicated by an arrow through the A-B cross section taken along the ink passage of the ink jet head.
Figure 3:
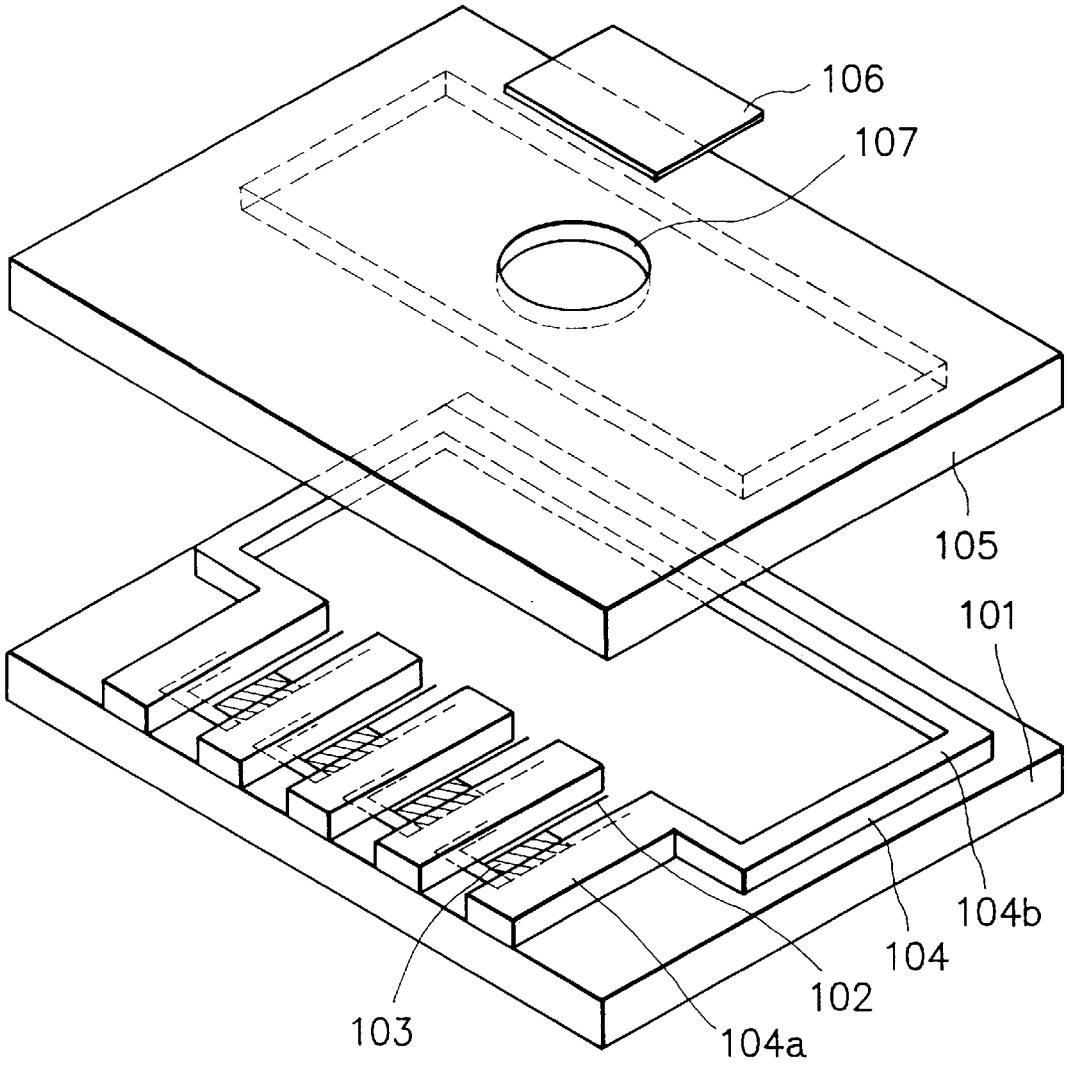
FIG. 3 is a schematic slant view illustrating the discharging element portion of the ink jet head shown in FIG. 1.
Figure 4:
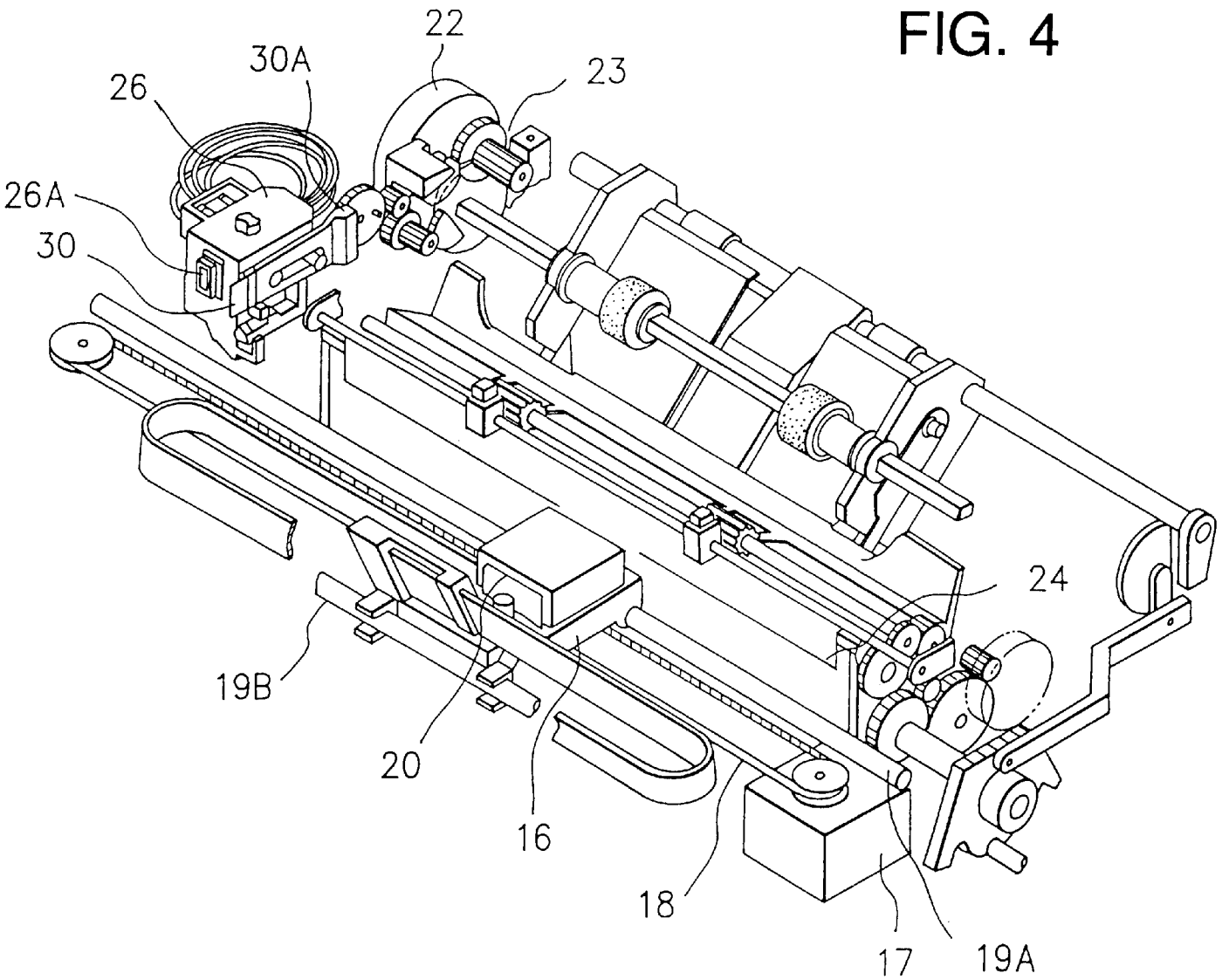
FIG. 4 is a schematic explanatory view illustrating an example of an ink jet apparatus provided with the ink jet head shown in FIG. 1.

The silicone-modified epoxy resin as a principal constituent of the sealing member in the present invention can be obtained using an epoxy resin and organosiloxane. Particularly, the sealing member in the present invention is usually formed by applying a coating material comprised of the foregoing silicone-modified epoxy resin composition by means of a dispenser or by way of a screen printing process, and because of this, it is required for the silicone-modified epoxy resin composition to be in the liquid state at room temperature. Especially as the sealing member is formed within an ink jet head, the silicone-modified epoxy resin composition is often necessary to be poured into a very narrow space. In this connection, the silicone-modified resin composition is necessary to be of a low viscosity, specifically, of 10 to 100,000 ps.

In addition, the silicone-modified epoxy resin composition is desired to be of a solvent-free series, other than the requirement therefor to be in the liquid state at room temperature. This is for the following reasons. That is, if the silicone-modified epoxy resin composition should be accompanied by a solvent, problems entail in that the solvent is gasified upon hardening the resin composition whereby causing a void in the resulting sealing member or/and a residue of the solvent remained without having been volatilized is often eluted through a portion thereof in contact with ink to contaminate into the ink whereby changing the property of the ink.

As the epoxy resin as a starting material for the silicone-modified epoxy resin which is used in the present invention, any epoxy resins can be used as long as they have two or more epoxy groups in one molecule and are in the liquid state at room temperature. Specific examples of such epoxy resin are bisphenol A type epoxy resin, bisphenol F type epoxy resin, bisphenol AD type epoxy resin, bisphenol AF type epoxy resin, novolak type epoxy resin, and modified resins of these epoxy resins. These resins may be used either singly or in combination of two or more of them. These resins are desired to be made free of an ionic impurity such as $Na^+$, $Cl^-$, or the like as much as possible.

As the organosiloxane used in the present invention, there can be used those having a functional group capable of reacting with the foregoing epoxy resin. Such functional group can include epoxy group, alcoxy group, hydroxyl group, amino group, and hydrosilyl group. Such organosiloxanes may be of a linear chain structure or a branched chain structure.

Specific examples of the organosiloxane usable in the present invention are those represented by the following formulas (I), (II) and (III). These are only for illustrative purposes and are not intended to restrict the organosiloxane used in the present invention to these.

(I)

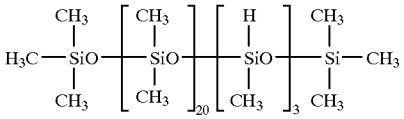

(II)

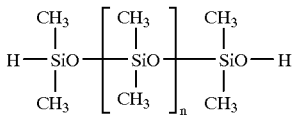

(n = 10~38)

-continued (III)

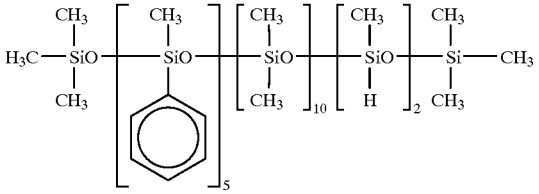

The silicone-modified epoxy resin used in the present invention may be produced by a conventional synthesis process. Specific examples of such synthesis process are (1) a synthesis process wherein an organosiloxane having an amino group is reacted with an epoxy resin having an epoxy group to produce an addition product, and (2) another synthesis process wherein an epoxy resin having an alkenyl group and an organosiloxane having a hydrosilyl group are subjected to hydrosilylation reaction in the presence of chloroplatinic acid to produce an addition product.

Of these two synthesis processes, the production of the silicone-modified epoxy resin used in the present invention in accordance with the synthesis process (2) is conducted, for example, in the following manner.

A mixture of 2-allylphenol and tributylamine is dropwise added to a predetermined amount of bisphenol A type epoxy resin while stirring under condition of 110° C., followed by stirring at 110° C. for a predetermined period of time. The resultant is subjected to vacuum distillation to remove unreacted 2-allylphenol and tributylamine, to obtain an alkenyl group-bearing epoxy resin. The alkenyl group-bearing epoxy resin in a predetermined amount, a solvent (for example, a mixture of methyl isobutyl ketone and toluene), and 2-ethylhexanol-modified chloroplatinic acid in a predetermined amount are mixed, followed by subjecting to azeotropic dehydration. Organopolysiloxane is dropwise added to the resultant mixture under reflux, followed by subjecting to reaction at 110° C. while stirring. The resultant is washed with water, followed by subjecting to vacuum distillation to remove the solvent, to thereby obtain a crude product. The crude product is dissolved in acetone to obtain a solution. Water is added to the solution, followed by allowing to stand, wherein a phase separation with two phases is occurred in the solution. The upper phase of the solution is removed, and the remaining lower phase is dissolved in acetone to obtain a solution. Water is added the solution, followed by allowing to stand, wherein a phase separation with two phases is occurred in the solution. The lower phase of the solution is separated from the solution, followed by subjecting to vacuum distillation to remove the acetone and water. Thus, there is obtained a desired silicone-modified epoxy resin.

In this synthesis process, the entire of the organopolysiloxane used is substantially added to the alkenyl group-bearing epoxy resin. Therefore, to adjust the silicone-modified degree for the resulting silicone-modified epoxy resin such that the silicone component is in a ratio of 10 to 60 parts by weight versus 100 parts by weight of the starting epoxy resin can be properly conducted by adjusting the amount of the alkenyl group-bearing epoxy resin to be used and the amount of the organopolysiloxane used to be respectively in the above corresponding range.

The silicone-modified epoxy resin used in the present invention is of a silicone component content which is made such that the silicone component is in an amount 10 to 60 parts by weight versus 100 parts by weight of the starting epoxy resin. In the case where the silicone component is less than 10 parts by weight, there cannot be attained a sufficient flexibility for the resulting sealing member, wherein the sealing member formed is liable to remove. On the other hand, in the case where the silicone component exceeds 60 parts by weight, there cannot be attained a sufficient gas barrier property for the resulting sealing member, wherein invasion of an air bubble is liable to occur.

As the hardener used in the present invention, conventional hardeners capable of hardening ordinary epoxy resins to provide one-component resin compositions can be selectively used. Particularly, there can be mentioned so-called latent hardeners having such properties that their admixture with an epoxy resin can be stably maintained over a long period of time without being changed in terms of the properties at room temperature and when heated to a give temperature or applied with an energy of light or the like, it is instantly hardened. Specifically, there can be illustrated those of the following three kinds of type in view of the chemical structure or the crosslinked structure of an hardened epoxy resin.

1) High Boiling Active Hydrogen Compounds

High boiling active hydrogen compounds capable of causing hardening by way of addition reaction with an epoxy resin. Specific examples are organic acid dihydrazides such as dicyandiamide, and adipic dihhdrazide.

2) Salts of Tertiary Amine and Imidazole

Salts of tertiary amines and salts of imidazoles which are of the high boiling dispersible type and the high boiling soluble type and which can be solubilized, decomposed or activated upon the application of heat to cause self-polymerization through an anionic mechanism for an epoxy resin. Specific examples are amineimide, 2-methylimidazole, 2-ethyl-4-methylimidazole, and 2-phenytlimidazole. These compounds function also as a hardening accelerator.

3) Salts of Lewis Acid and Brensted Acid

Salts of Lewis acids and salts of Brensted acids which can cause polymerization through a cationic mechanism for an epoxy resin upon the application of heat. Specific examples are monoethylamine salts of chlorotrifluorides, aliphatic sulfonium salts of Brensted acids, aromatic diazonium salts, and aromatic sulfonium salts.

Any of these latent hardeners can be optionally used in the present invention.

The silicone-modified epoxy resin composition used for the formation of a sealing member according to the present invention contains the foregoing silicone-modified epoxy resin and the foregoing hardener as the essential components, but it may contain an inorganic filler, a hardening accelerator, or a silane coupling agent, if necessary. Further, the silicone-modified epoxy resin composition may contain an epoxy resin not having subjected to silicone-modification within a range of not hindering the object of the present invention.

The sealing member according to the present invention is applied principally to a joint of an ink passage of an ink jet head. Particularly, it provides prominent advantages when it is applied to joint portions of ink passages from an ink container through the ink jet head. Other than this, it is possible for the sealing member to be applied to wiring portions of the ink jet head.

The present invention is suitably applicable in an ink jet printing system. Particularly, the present invention provides prominent advantages in an ink jet head and an ink jet apparatus of the system in which ink is discharged to form an ink droplet utilizing thermal energy whereby conducting printing.

As for the representative constitution and the principle, it is desired to adopt such fundamental principle as disclosed, for example, in U.S. Pat. No. 4,723,129 or U.S. Pat. No. 4,740,796. While this system is capable of applying to either the so-called on-demand type or the continuous type, it is particularly effective in the case of the on-demand type. In the printing system of the on-demand type, by applying at least one driving signal for providing a rapid temperature rise exceeding nucleate boiling in response to printing information to an electrothermal converting body disposed for a sheet on which liquid (ink) is to be held or a liquid pathway, the electrothermal converting body generates thermal energy to cause film boiling at ink on a heat acting face of the ink jet head and as a result, a bubble can be formed in the liquid (the ink) in a one-by-one corresponding relationship to such driving signal. By way of growth and contraction of this bubble, the liquid (the ink) is discharged through a discharging outlet to form at least one droplet. It is more desirable to make the driving signal to be of a pulse shape, since in this case, growth and contraction of a bubble take place instantly and because of this, there can be attained discharging of the liquid (the ink) excelling particularly in responsibility. As the driving signal of pulse shape, such driving signal as disclosed in U.S. Pat. No. 4,463,359 or U.S. Pat. No. 4,345,262 is suitable. Additionally, in the case where those conditions disclosed in U.S. Pat. No. 4,313,124, which relates to the invention concerning the rate of temperature rise at the heat acting face, are adopted, further improved recording can be performed.

As for the constitution of the ink jet head, the present invention includes, other than those constitutions of the discharging outlet, liquid pathway and electrothermal converting body in combination (linear liquid flow pathway or perpendicular liquid flow pathway) which are disclosed in each of the above patent specifications, such constitution having a heat acting portion disposed in a curved region as disclosed in U.S. Pat. No. 4,558,333 or U.S. Pat. No. 4,459,600.

In addition, the present invention may effectively take a constitution based on the constitution in which a slit common to a plurality of electrothermal converting bodies is used as a discharging portion of the electrothermal converting bodies which is disclosed in Unexamined Patent Publication NO. 123670/1984 or other constitution based on the constitution in which an opening for absorbing a pressure wave of thermal energy is made to be corresponding to a discharging portion which is disclosed in Unexamined Japanese Patent Publication No. 138461/1984.

The ink jet head in which the present invention can be effectively applied includes a full-line type ink jet head having a length corresponding to the width of a maximum printing medium for which printing can be performed by an ink jet apparatus. As for the full-line type ink jet head, there can be employed either such constitution that the length is completed by such a combination of a plurality of ink jet heads as disclosed in the foregoing patent specifications or other constitution comprising a single ink jet head formed as an integrated structure.

The present invention is effective also in an ink jet head of the exchangeable chip type wherein electric connection to an apparatus body or supply of ink from the apparatus body is enabled when it is mounted on the apparatus body or in other ink jet head of the cartridge type wherein an ink container is integrally provided on the ink jet head itself.

Further, it is desirable to add preparatory auxiliary means to an ink jet apparatus according to the present invention in view of stabilizing the effects of the ink jet apparatus. Specifically, the addition of preliminary heating means including an electrothermal converting body or a separate heating element or a combination of these, and to employ a preparatory discharging mode in which discharging is performed separately from printing, are also effective in order to achieve stable printing.

Further in addition, the present invention is extremely effective not only in an ink jet apparatus which has, as the printing mode, a printing mode of a main color such as black but also in an ink jet apparatus which includes a plurality of different colors or at least one of full-colors by color mixture, in which an ink jet head is integrally constituted or a plurality of ink jet heads are combined.

In the above mentioned examples of the present invention, explanation has been made with the use of liquid ink, but it is possible to use such ink that is in the solid state at room temperature or other ink that becomes to be in a softened state at room temperature in the present invention. In the foregoing ink jet apparatus, it is usual to adjust the temperature of ink itself in the range of 30° C. to 70° C. such that the viscosity of the ink lies in the range capable of being stably discharged. In view of this, any ink can be used as long as it is in the liquid state upon the application of a use record signal.

In addition, in the present invention, it is possible to use those inks having a property of being liquefied, for the first time, with thermal energy, such as ink that can be liquefied and discharged in liquid state upon the application of thermal energy depending upon a printing signal or other ink that can start solidification beforehand at the time of its arrival at a printing medium in order to prevent the temperature of the ink jet head from raising due to thermal energy by purposely using thermal energy as the energy for a state change of ink from solid state to liquid state or in order to prevent ink from being vaporized by solidifying the ink in a state of being allowed to stand. In the case of using these inks, there can be used such a manner as disclosed in Unexamined Japanese Patent Publication No. 56847/1979 or Unexamined Japanese Patent Publication No. 71260/1985 wherein such ink is maintained in concaved portions or penetrations of a porous sheet in the liquid state or in the solid state and the porous sheet is arranged such that it is situated opposite the electrothermal converting body.

In the present invention, the most effective discharging system for the above mentioned inks is the foregoing film-boiling system.

EXPERIMENTS

In the following, description will be made of experiments conducted by the present inventors.

In view of the foregoing problems caused by the sealing member in the conventional ink jet head in that an air bubble is liable to invade into the ink passage or/and common ink chamber when printing is continuously conducted over a long period of time and a removal is liable to occur at the sealing member when highly alkaline ink is used in the above printing, the present inventors made studies through experiments in order to obtain an improved sealing member which is free of such problems found in the prior art and which excels in airtightness and ink resistance.

That is, the present inventors made extensive studies in order to realize a desirable sealing member excelling particularly in ink resistance and capable of eliminating the problems in the prior art by making use of the excellent gas barrier property possessed by an epoxy resin while eliminating the problem of the epoxy resin of causing a stress. Particularly, the present inventors made studies of whether or not the foregoing silicone-modified epoxy resin composition is effective in realizing said desirable sealing member which can eliminate the problems found in the conventional ink jet head, through the following experiments A-1 to A-11 wherein sealing materials for the formation of a sealing member were produced and the sealing materials were evaluated with respect to ink resistance, gas barrier property and low stress property desired for a sealing member in an ink jet head.

Experiment A-1

There was obtained a silicone-modified epoxy resin in accordance with the foregoing synthesis process (2). That is, there was provided an alkenyl group-bearing bisphenol A type epoxy resin EPIKOTE 823 (trademark name, produced by Yuka Shell Kabushiki Kaisha). The epoxy resin and hydroxyl group-bearing organopolysiloxane represented by the foregoing formula (II) (in the formula (II), n=10) were mixed, followed by subjecting to hydrosilylation reaction in the presence of a platinum chloride catalyst, to thereby obtain a silicone-modified epoxy resin. The silicone component content of the resultant silicone-modified epoxy resin was found to be 30 parts by weight versus 100 parts by weight of the starting epoxy resin.

60 parts by weight of an amine series latent hardener comprising NOVACURE HX-3155 (trademark name, produced by Asahi Chemical Industry Co., Ltd.) was well mixed with 100 parts by weight of the silicone-modified epoxy resin. Then, 5 parts by weight of an epoxy series silane coupling agent A-187 (trade name, produced by Nippon Unicar Kabushiki Kaisha) was well mixed with the resultant. Thus, there was obtained an one-component silicone-modified epoxy resin composition.

Experiment A-2

There was obtained a silicone-modified epoxy resin in the same manner as in Experiment A-1, except for using a bisphenol F type epoxy resin EPIKOTE 807 (trademark name, produced by Yuka Shell Kabushiki Kaisha) as the starting material for the silicone-modified epoxy resin and hydrosilyl group-bearing organopolysiloxane having the foregoing formula (I). The silicone component content of the resultant silicone-modified epoxy resin was found to be 40 parts by weight versus 100 parts by weight of the starting epoxy resin.

2 parts by weight of a cation ultraviolet hardening initiator comprising ADEKAOPTOMER SP-170 (trademark name, produced by Asahi Denka Kogyo Kabushiki Kaisha) was well mixed with 100 parts by weight of the silicone-modified epoxy resin. Then, 5 parts by weight of an epoxy series silane coupling agent A-187 (trade name, produced by Nippon Unicar Kabushiki Kaisha) was well mixed with the resultant. Thus, there was obtained an one-component silicone-modified epoxy resin composition.

Experiment A-3

The procedures of Experiment A-1 were repeated, except that the silicone component content of the silicone-modified epoxy resin was adjusted to be 5 parts by weight versus 100 parts by weight of the starting epoxy resin, to thereby obtain an one-component silicone-modified epoxy resin composition.

Experiment A-4

The procedures of Experiment A-1 were repeated, except that the silicone component content of the silicone-modified epoxy resin was adjusted to be 10 parts by weight versus 100 parts by weight of the starting epoxy resin, to thereby obtain an one-component silicone-modified epoxy resin composition.

Experiment A-5

The procedures of Experiment A-1 were repeated, except that the silicone component content of the silicone-modified epoxy resin was adjusted to be 20 parts by weight versus 100 parts by weight of the starting epoxy resin, to thereby obtain an one-component silicone-modified epoxy resin composition.

Experiment A-6

The procedures of Experiment A-1 were repeated, except that the silicone component content of the silicone-modified epoxy resin was adjusted to be 40 parts by weight versus 100 parts by weight of the starting epoxy resin, to thereby obtain an one-component silicone-modified epoxy resin composition.

Experiment A-7

The procedures of Experiment A-1 were repeated, except that the silicone component content of the silicone-modified epoxy resin was adjusted to be 50 parts by weight versus 100 parts by weight of the starting epoxy resin, to thereby obtain an one-component silicone-modified epoxy resin composition.

Experiment A-8

The procedures of Experiment A-1 were repeated, except that the silicone component content of the silicone-modified epoxy resin was adjusted to be 60 parts by weight versus 100 parts by weight of the starting epoxy resin, to thereby obtain an one-component silicone-modified epoxy resin composition.

Experiment A-9

The procedures of Experiment A-1 were repeated, except that the silicone component content of the silicone-modified epoxy resin was adjusted to be 70 parts by weight versus 100 parts by weight of the starting epoxy resin, to thereby obtain an one-component silicone-modified epoxy resin composition.

Experiment A-10

The procedures of Experiment A-1 were repeated, except that the silicone component content of the silicone-modified epoxy resin was adjusted to be 80 parts by weight versus 100 parts by weight of the starting epoxy resin, to thereby obtain an one-component silicone-modified epoxy resin composition.

Experiment A-11

There was obtained a silicone-modified epoxy resin in the same manner as in Experiment A-1, except for using a solid bisphenol A type epoxy resin EPIKOTE 1001 (trademark name, produced by Yuka Shell Kabushiki Kaisha) as the starting material for the silicone-modified epoxy resin. The silicone component content of the resultant silicone-modified epoxy resin was found to be 20 parts by weight versus 100 parts by weight of the starting epoxy resin.

60 parts by weight of a phenol resin hardener dissolved in a solvent comprising methyl isobutyl ketone was well mixed with 100 parts by weight of the silicone-modified epoxy resin. Then, 5 parts by weight of an epoxy series silane coupling agent A-187 (trade name, produced by Nippon Unicar Kabushiki Kaisha) was well mixed with the resultant. Thus, there was obtained an one-component silicone-modified epoxy resin composition.

Each of the silicone-modified resin compositions obtained in Experiments A-1 to A-11 was examined of whether or not it is effectively usable as a sealing member for an ink jet head by evaluating it with respect to resistance to ink, gas barrier property, and stress occurrence situation which are required for the sealing member in the following manner.

Evaluation of the Resistance to Ink

As for each silicone-modified resin composition (hereinafter referred to as resin sample), the degree of swelling to ink and the presence or absence of an elute into ink were evaluated. That is, there were provided highly alkaline ink (pH: 10.7, composition: GLY 10.0, urea 5.0, IPA 5.0, lithium hydroxide 0.4, and ammonium sulfate 0.5) and ink for a BJ cartridge BC-01 produced by Canon Kabushiki Kaisha. The resin sample was immersed in each of these inks, followed by allowing to stand at 120° C. for 10 hours using PCT, wherein the degree of swelling to the ink and the presence or absence of an elute into the ink were evaluated in the following manner.

1) Evaluation of the Degree of Swelling to Ink

The weight of the resin sample was measured before and after its immersion into the ink. Evaluation was conducted based on the following criteria: ◎ for a case wherein the rate of a change in the weight is less than 1%, ○ for a case wherein the rate of a change in the weight is in the range of 1% to 5%, and X for a case wherein the rate of a change exceeds 5%. The evaluated results are shown in Table 1.

2) Evaluation of the Presence or Absence of an Elute into Ink

As for the ink into which the resin sample had been immersed, the presence or absence of an organic foreign matter eluted in the ink was examined by means of a spectrophotometer. In addition to this, the presence or absence of an inorganic foreign matter eluted in the ink was examined by means of ICP-ACS (inductively coupled plasma atomic emission spectroscopy). On the basis of the results, evaluation was conducted based on the following criteria. The evaluated results are shown in Table 1.

○: a case wherein neither an eluted organic foreign matter nor an eluted inorganic foreign matter are observed, and X: a case wherein at least an eluted organic foreign matter or an eluted inorganic foreign matter is observed.

The occurrence of swelling herein means that the material will be deteriorated. Particularly, when the degree of the swelling to ink is great, there is a tendency of causing a serious problem in terms of the adhesion. As for the resin sample which is less than 5% for the rate of a change in the weight, it is understood that the resin sample satisfies the requirements for the sealing member. Especially, as for the resin sample which is less than 1% for the rate of a change in the weight, it is understood that the resin sample is very suitably used as the sealing member, wherein the sealing member is absolutely free from a problem of causing a removal.

Now, the elution of a foreign matter into ink changes the property of the ink, resulting in a problem of preventing the ink from being effectively discharged. In the case where the eluted foreign matter is an inorganic material, examples of such inorganic material are metals such as Cr, Si, Ca, Zn, Mg, Mn, Al, Fe, Ni, Cd, Cu, and Sn. When the ink contains of an elute of such inorganic material, there is a tendency of entailing problems such that the elute causes scorching on a heater or it reacts with gas in the air to form an undesired material in the ink, resulting in filling a discharging outlet with such material formed in the ink. In the case where the eluted foreign mater is an organic material, example of such organic material are solvents, plasticizers, and unreacted materials. When the ink contains an elute of such organic material, there is a tendency of entailing problems such that the elute changes the surface tension or/and viscosity of the ink, resulting in preventing the ink from being effectively discharged. Further, in the case where the elute is a coloring material, there is a tendency of changing the color of the ink.

Evaluation of the Gas Barrier Property (the airtightness)

As for each resin sample, evaluation was conducted with respect to gas barrier property (airtightness) required in the case of using it as the sealing member by examining its gas permeability. Particularly, The gas permeability was measured by means of a fully automatic gas permeability tester L100-4002 (trade name, produced by Dr. LYSSY Company), wherein air was used as the test gas.

The measured results were subjected to evaluation on the basis of the following criteria. The evaluated results obtained are shown in Table 1.

◎: a case wherein the gas permeability is less than 500 $ml/m^2$.d.atm,

○: a case wherein the gas permeability is in the range of 500 $ml/m^2$.d.atm to 1000 $ml/m^2$.d.atm, and X: a case wherein the gas permeability exceeds 1000 $ml/m^2$.d.atm.

The "$ml/m^2$.d.atm" herein indicates how many milliliters of gas have been permeated through a sample per a 1 $m^2$ volume thereof under an atmosphere of 1 atm for one day. In the case where the resin sample is of less than 1000 $ml/m^2$.d.atm in gas permeability, it is understood that any particular treatment is not necessary to be conducted for preventing air bubble from being invaded thereinto as long as the resin sample is used in the ordinary manner. In the case where the resin sample is of less than 500 $ml/m^2$.d.atm, it is understood that any particular treatment is not necessary to be conducted for preventing air bubble from being invaded thereinto even in the case where the resin sample has not been used over about three months.

Evaluation of the Stress Occurrence Situation

In order to examine the situation of a stress occurred when used as the sealing member, each resin sample was subjected to heat cycle test. In the heat cycle test, there were conducted a so-called 3-zone heat cycle test and a so-called 2-zone heat cycle test. Each of these test was conducted in the following manner, wherein the situation of causing a removal at the resin sample used as the sealing member was observed.

3-Zone Heat Cycle Test 0.5 g of the resin sample was applied onto the surface of a glass substrate, followed by hardening, to thereby form a film on the substrate. The substrate was immersed in highly alkaline ink (pH: 10.7, composition: GLY 10.0, urea 5.0, IPA 5.0, lithium hydroxide 0.4, and ammonium sulfate 0.5), and the substrate in the highly alkaline ink was allowed to stand in each of a first zone (1) maintained at −30° C., a second zone (2) maintained at room temperature and a third zone (3) maintained at 60° C. for 2 hours, wherein a cycle comprising the steps of maintaining in the −30° C. zone, then maintaining in the room temperature zone, thereafter maintaining in the 60° C. zone, then maintaining in the room temperature zone, thereafter maintaining in the −30° C. zone was repeated 10 times. After having subjected the substrate to this treatment, examinated was conducted of the situation of occurrence of a removal at the film on the substrate by means of a microscope.

2-Zone Heat Cycle Test

There was prepared a test sample in the same manner as in the 3-zone heat cycle test. The test sample obtained was treated in the same manner as in the 3-zone heat cycle test, except that the test sample in the ink was allowed to stand in each of a first zone (1) maintained at −30° C. and a second zone (2) maintained at 60° C. for 2 hours wherein a cycle comprising the steps of maintaining in the −30° C. zone, then maintaining in the 60° C. zone, and maintaining in the −30° C. zone was repeated 50 times. After having subjected the test sample to this treatment, examinated was conducted of the situation of occurrence of a removal at the film on the substrate by means of a microscope.

The examined results obtained were subjected to evaluation on the basis of the following criteria. The evaluated results are shown in Table 1.

◎: a case wherein no removal is observed in both the 3-zone heat cycle test and the 2-zone heat cycle test, ○: a case wherein a removal is observed only in the 3-zone heat cycle test, and X: a case wherein a removal is observed in both the 3-zone heat cycle test and the 2-zone heat cycle test.

Herein, as for the resin sample for which no removal is occurred in the 3-zone heat cycle test, it is understood that no removal is occurred upon the use under the ordinary use environment. As for the resin sample for which no removal is occurred in the 2-zone heat cycle test, it is understood that no removal is occurred upon the use under severe use environment.

Total Evaluation

The evaluated results as for the foregoing evaluation items were subjected to total evaluation on the basis of the following criteria. The results obtained are shown in Table 1.

◎: a case wherein the resin sample is satisfactory for all the evaluation items, ◎: a case wherein the resin sample is not sufficiently satisfactory for a part of the evaluation items but it is practically usable, and X: a case wherein the resin sample is problematic in its practical use.

For the comparison purposes, there were prepared four samples in the following experiments. The resultant samples were evaluated in the same manner as in the above. The evaluated results obtained are shown in Table 2.

Experiment B-1

There was prepared a sealing member sample using an one-component de-alcohol moisture curing type silicone sealant TSE 397 (trade name, produced by Toshiba Silicone Kabushiki Kaisha), wherein the hardening was conducted at 50° C. for 8 hours.

Experiment B-2

There was prepared a sealing member sample using an one-component epoxy resin comprising VYNAL E-405 (trademark name, produced by Kanae Chemical Industry), wherein the hardening was conducted at 120° C. for 60 minutes.

Experiment B-3

There was prepared a sealing member sample using an one-component anaerobic, ultraviolet-curing, modified acrylate resin comprising 4X678B (trade name, produced by Chemitec Company), wherein the hardening was conducted in a manner, wherein the irradiation of ultraviolet rays with 450 mj/cm$^2$ was conducted, followed by subjecting heat treatment at 120° C. for 5 minutes.

Experiment B-4

There was prepared a sealing member sample using a two component mixture comprising an elastic epoxy resin ECCOBOND 45LV and an elastic epoxy resin ECCOBOND 15LV (trademark names, produced by Grace Japan Company) with a mixing ratio of 100:150, wherein the hardening was conducted at 70° C. for 120 minutes and then at 90° C. for 40 minutes.

From the results shown in Tables 1 and 2, there were obtained the following findings.

In the evaluation of the resistance to ink, it is understood that each of the samples obtained in Experiments A-3, B-2, B-3, and B-4 exceeded 5% in terms of the degree of swelling to each of the highly alkaline ink and the ink for the cartridge BC-01. As for the sample of Experiment A-3, the reason for this is considered such that the silicone component content was slight and the property thereof was therefore approximate to that of a epoxy resin, and because of this, it didn't exhibit a sufficient anti-swelling performance to any of the above inks.

As for the elution of a foreign matter into ink, it is understood that each of the samples obtained in Experiments A-11, B-3 and B-4 had a foreign matter elute into each of the highly alkaline ink and the ink for the cartridge BC-01. As for the sample of Experiment A-11, the reason for this is considered such that the solvent contained in the silicone-modified epoxy resin eluted into these inks.

In the evaluation of the gas barrier property, it is understood that each of the samples obtained in Experiments A-9, A-10, B-2, and B-3 showed a value exceeding 1000 ml/m$^2$ .d.atm. As for each of the samples of Experiments A-9 and A-10, the reason for this is considered such that the silicone component content was relatively great and the property thereof was therefore similar to that of a silicone, and because of this, it didn't exhibit a sufficient gas barrier performance.

In the evaluation of the stress occurrence situation, each of the samples obtained in Experiments A-3, B-2 and B-3 caused a removal also in the 3-zone heat cycle test. As for the sample of Experiment A-3, the reason for this is considered such that the silicone component content was slight, the property thereof was therefore approximate to that of a epoxy resin, and it was insufficient in flexibility, and because of this, it didn't exhibit a sufficient performance to prevent occurrence of a stress.

In view of the above, it is understood that the silicone-modified epoxy resin composition according to the present invention provides prominent advantages when it is used as a sealing member to seal the joint portions of the constituent materials for the ink passage in an ink jet head, in that the sealing member sufficiently seal the joint portions in an improved airtight state which is maintained without the sealing member being removed.

Of the resin samples obtained in the above experiments, those obtained in Experiments A-1, A-2, A-4, A-5, A-6, and A-7 belong to the present invention. And of these resin samples belonging the present invention, those obtained in Experiments A-1, A-2 and A-6 are most desirable for using as a sealing member in an ink jet head because they are extremely satisfactory in all the requirements desired for the sealing member in an ink jet head.

In the following, an example of the present invention will be described. In the following example, the silicone-modified epoxy resin composition obtained in the foregoing Experiment A-1 was used as a sealing member in an ink jet head, and the performance of the sealing member was examined. For comparison purposes, there will be described comparative examples, wherein each of the samples obtained in Experiments A-11 and B-1 was used as a sealing member in an ink jet head and the performance of the sealing member was examined.

EXAMPLE 1

Figure 5:
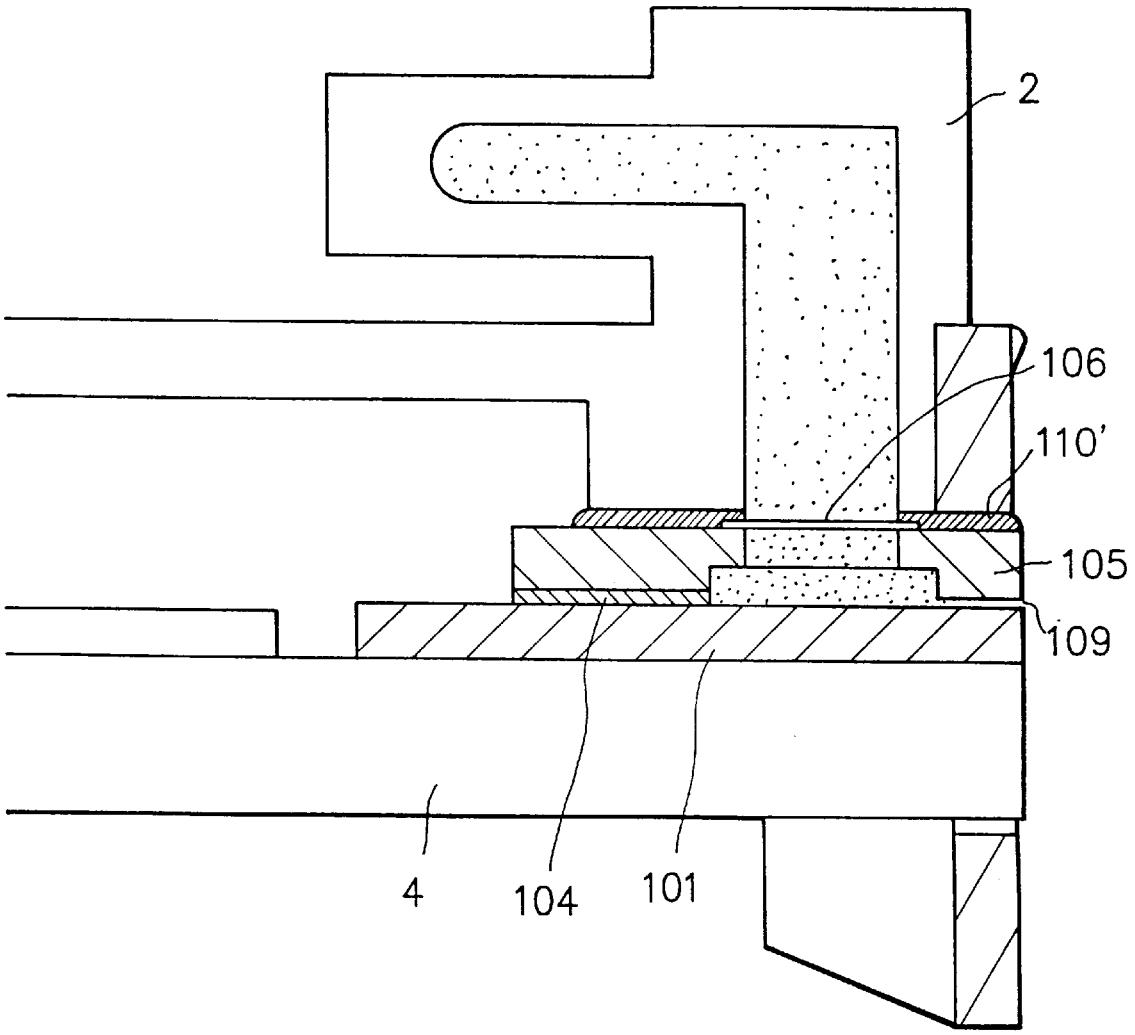
FIG. 5 is a schematic cross-sectional view of a principal portion of an ink jet head according to the present invention.

FIG. 5 is a schematic cross-sectional view of a principal portion of an ink jet head according to the present invention.

In the figure, reference numeral 2 indicates an ink supply unit for supplying ink, reference numeral 4 an aluminum base plate for the ink jet head, reference numeral 101 a silicon wafer base member, reference numeral 104 an ink pathway wall, reference numeral 105 a top plate, reference numeral 106 a filter for ink, reference numeral 109 a discharging outlet, and reference numeral 110' a sealing member.

There was provided a top plate 105 for an ink jet head shown in FIG. 5 which had been prepared by the conventional manner. On to the top plate, the one-component silicone-modified epoxy resin composition obtained in the foregoing Experiment A-1 was applied at a thickness of 50 um by means of the screen printing process. To the resultant, an ink supply unit 2 was joined, followed by subjecting to hardening treatment at 80° C. for 4 hours. Thus, there was obtained an ink jet head.

The ink container of the ink jet head thus obtained was charged with highly alkaline ink (pH: 10.7, composition: GLY 10.0, urea 5.0, IPA 5.0, lithium hydroxide 0.4, and ammonium sulfate 0.5). The ink jet head was then allowed to stand in an atmosphere of 35° C. for the environmental temperature and 10% for the environmental humidity for 10 days. The ink jet head having been thus treated was continuously operated to conduct printing until all the 20 g of the highly alkaline ink contained in the ink container was terminated. As a result, desirable printing could be continuously conducted without causing any defective print and without causing any defect in the ink discharging performance, wherein the removal of an air bubble was not necessitated.

Comparative Example 1

The procedures of Example 1 were repeated, except that the one-component silicone-modified epoxy resin composition obtained in the foregoing Experiment A-11 was used as the sealing member for the ink jet head, to thereby obtained an ink jet head.

As well as in Example 1, the ink container of the ink jet head thus obtained was charged with highly alkaline ink (pH: 10.7, composition: GLY 10.0, urea 5.0, IPA 5.0, lithium hydroxide 0.4, and ammonium sulfate 0.5). The ink jet head was then allowed to stand in an atmosphere of 35° C. for the environmental temperature and 10% for the environmental humidity for 10 days. The ink jet head having been thus treated was continuously operated to conduct printing until all the 20 g of the highly alkaline ink contained in the ink container was terminated. As a result, although non-ink discharging was not occurred, there were provided some print products accompanied by defective print images.

Comparative Example 2

The procedures of Example 1 were repeated, except that the one-component silicone-modified epoxy resin composition in the foregoing Experiment B-1 was used as the sealing member for the ink jet head, to thereby obtained an ink jet head.

As well as in Example 1, the ink container of the ink jet head thus obtained was charged with highly alkaline ink (pH: 10.7, composition: GLY 10.0, urea 5.0, IPA 5.0, lithium hydroxide 0.4, and ammonium sulfate 0.5). The ink jet head was then allowed to stand in an atmosphere of 35° C. for the environmental temperature and 10% for the environmental humidity for 10 days. The ink jet head having been thus treated was continuously operated to conduct printing until all the 20 g of the highly alkaline ink contained in the ink container was terminated. As a result, non-ink discharging was sometimes occurred, and there were provided some print products accompanied by defective print images.

From the above described results, it is understood that the silicone-modified epoxy resin composition according to the present invention provides prominent advantages when it is used as a sealing member to seal the joint portions of the constituent materials for the ink passage in an ink jet head, in that there is provided a highly reliable ink jet head in which the sealing member sufficiently seal the joint portions in an improved airtight state which is maintained without the sealing member being removed even when the ink jet head is continuously operated over a long period of time, and which always performs stable ink discharging to continuously provide a high quality print product.

TABLE 1

| Experiment | | | A-1 | A-2 | A-3 | A-4 | A-5 | A-6 | A-7 | A-8 | A-9 | A-10 | A-11 |
|---|---|---|---|---|---|---|---|---|---|---|---|---|---|
| bisphenol A type epoxy resin (alkenyl group) | | | 100 | | 100 | 100 | 100 | 100 | 100 | 100 | 100 | 100 | |
| bisphenol F type epoxy resin (alkenyl group) | | | | 100 | | | | | | | | | |
| solid bisphenol A type epoxy resin (alkenyl group) | | | | | | | | | | | | | 100 |
| organopolysiloxane (hydrosilyl group) | | | 30 | 40 | 5 | 10 | 20 | 40 | 50 | 60 | 70 | 80 | 20 |
| resistance to ink | degree of swelling | highly alkaline ink | ◎ | ◎ | X | ○ | ○ | ◎ | ◎ | ◎ | ◎ | ○ | ○ |
| | | BC-01 ink | ◎ | ◎ | ○ | ○ | ◎ | ◎ | ◎ | ◎ | ◎ | ○ | ◎ |
| | presence of elute | highly alkaline ink | ○ | ○ | ○ | ○ | ○ | ○ | ○ | ○ | ○ | ○ | X |
| | | BC-01 ink | ○ | ○ | ○ | ○ | ○ | ○ | ○ | ○ | ○ | ○ | X |
| gas barrier property | | | ◎ | ◎ | ◎ | ◎ | ◎ | ◎ | ○ | ○ | X | X | ○ |
| stress occurrence (heat cycle test) | | | ◎ | ◎ | X | ○ | ◎ | ◎ | ◎ | ◎ | ◎ | ○ | ○ |
| total evaluation | | | ◎ | ◎ | X | ○ | ○ | ◎ | ○ | ○ | X | X | X |

TABLE 2

| Experiment | | | B-1 | B-2 | B-3 | B-4 |
|---|---|---|---|---|---|---|
| de-alcohol moisture curing type siliconese alant (TSE 397) | | | 100 | | | |
| one-component epoxy resin (VYNAL E-405) | | | | 100 | | |
| one-component anaerabic, ultraviolet curing, modified resin (4X678B) | | | | | 100 | |
| elastic epoxy resin (ECCOBOND 45LV/15LV) | | | | | | 100 |
| resistance to ink | degree of swelling | highly alkaline ink | ○ | X | X | X |
| | | BC-01 ink | ○ | ○ | X | X |
| | presence of elute | highly alkaline ink | ○ | ○ | X | X |
| | | BC-01 ink | ○ | ○ | X | X |
| gas barrier property | | | X | ◎ | ○ | ◎ |
| stress occurrence (heat cycle test) | | | ○ | X | X | ◎ |
| total evaluation | | | X | X | X | X |

What is claimed is:

1. An ink jet head having an ink supply passage communicating with an ink discharging outlet, said ink supply passage being formed by joining a plurality of ink supply passage-forming members, characterized in that a joined portion of said plurality of ink supply passage-forming members is provided with a sealing member formed of a composition comprising a one-component silicone-modified epoxy resin as a principal component and a latent hardener, said silicone-modified epoxy resin being free of solvent and in the liquid state at room temperature.

2. An ink jet head according to claim 1, wherein the silicone-modified epoxy resin comprises a silicone component in an amount of 10 to 60 parts by weight versus 100 parts by weight of an epoxy resin component.

3. An ink jet head according to claim 1, wherein the silicone-modified epoxy resin is obtained from an epoxy resin and an organosiloxane.

4. An ink jet head according to claim 3, wherein the epoxy resin is an epoxy resin in the liquid state at room temperature selected from bisphenol A type epoxy resin, bisphenol F type epoxy resin, bisphenol AD type epoxy resin, bisphenol AF type epoxy resin, novolak type epoxy resin, and modified resins of these resins.

5. An ink jet head according to claim 3, wherein the organosiloxane has at least one functional group selected from the group consisting of an epoxy group, alkoxy group, hydroxyl group, amino group, and hydrosilyl group.

6. An ink jet head according to claim 1, wherein the latent hardener is an organic acid hydrazide.

7. An ink jet head according to claim 1, wherein the latent hardener is selected from the group consisting of salts of tertiary amines and salts of imidazoles.

8. An ink jet head according to claim 1, wherein the latent hardener is selected from the group consisting of salts of Lewis acids and salts of Brensted acids.

9. An ink jet head according to claim 1, wherein the composition contains a silane coupling agent.

10. An ink jet head according to claim 1, wherein the ink let head has a configuration in which a state change is caused in ink due to thermal energy generated by an electrothermal converting body when electric energy is applied to said electrothermal converting body, whereby ink is discharged.

11. An ink jet head according to claim 1 which has a full-line configuration which has a plurality of ink discharging outlets arranged in accordance with an entire width of the printing area of a printing medium on which printing is to be performed.

12. An ink jet apparatus including an ink jet head for discharging ink and a suction recovery means for conducting suction recovery treatment for said ink jet head, said ink jet head having an ink supply passage communicating with an ink discharging outlet, said ink supply passage being formed by joining a plurality of ink supply passage-forming members, characterized in that a joined portion of said plurality of ink supply passage-forming members in said ink jet head is provided with a sealing member formed of a composition comprising a one-component silicone-modified epoxy resin as a principal component and a latent hardener, said silicone-modified epoxy resin being free of solvent and in the liquid state at room temperature.

13. An ink jet apparatus according to claim 13, wherein the silicone-modified epoxy resin comprises a silicone component in an amount of 10 to 60 parts by weight versus 100 parts by weight of an epoxy resin component.

14. An ink jet apparatus according to claim 12, wherein the silicone-modified epoxy resin is obtained from an epoxy resin and an organosiloxane.

15. An ink jet apparatus according to claim 14, wherein the epoxy resin is an epoxy resin in the liquid state at room temperature selected from bisphenol A type epoxy resin, bisphenol F type epoxy resin, bisphenol AD type epoxy resin, bisphenol AF type epoxy resin, novolak type epoxy resin, and modified resins of these resins.

16. An ink jet apparatus according to claim 14, wherein the organosiloxane has at least one functional group selected from the group consisting of an epoxy group, alkoxy group, hydroxyl group, amino group, and hydrosilyl group.

17. An ink jet apparatus according to claim 12, wherein the latent hardener is an organic acid hydrazide.

18. An ink jet apparatus according to claim 12, wherein the latent hardener is selected from the group consisting of salts of tertiary amines and salts of imidazoles.

19. An ink jet apparatus according to claim 12, wherein the latent hardener is selected from the group consisting of salts of Lewis acids and salts of Brensted acids.

20. An ink jet apparatus according to claim 12, wherein the composition contains a silane coupling agent.

21. An ink jet apparatus according to claim 13, wherein the ink jet head has a configuration in which a state change is caused in ink due to thermal energy generated by an electrothermal converting body when electric energy is applied to said electrothermal converting body, whereby ink is discharged.

22. An ink jet apparatus according to claim 12, wherein the ink jet head has a full-line configuration which has a plurality of discharging outlets arranged in accordance with an entire width of the printing area of a printing medium on which printing is to be performed.

* * * * *

UNITED STATES PATENT AND TRADEMARK OFFICE

CERTIFICATE OF CORRECTION

PATENT NO. : 5,953,023

DATED : September 14, 1999

INVENTOR(S) : AKIHIKO SHIMOMURA, ET AL.

It is certified that error appears in the above-identified patent and that said Letters Patent is hereby corrected as shown below:

COLUMN 1:

Line 39, "a A-B" should read --an A-B--.

COLUMN 4:

Line 2, "are" should read --is--.
Line 4, "other" should read --another--.
Line 28, "whereby" should read --thereby--.
Line 45, "using" should read --used--.

COLUMN 5:

Line 29, "a ink" should read --an ink--.
Line 51, "property" should read --property of--.
Line 52, "was" should read --were--.
Line 59, "ensures" should read --it ensures--.
Line 62, "having" should read --has--.
Line 66, "of an" should read --of a--.

COLUMN 6:

Line 13, "having" should be deleted.
Line 16, "an" should be deleted.

UNITED STATES PATENT AND TRADEMARK OFFICE

CERTIFICATE OF CORRECTION

PATENT NO. : 5,953,023

DATED : September 14, 1999

INVENTOR(S) : AKIHIKO SHIMOMURA, ET AL.

It is certified that error appears in the above-identified patent and that said Letters Patent is hereby corrected as shown below:

COLUMN 7:

Line 17, "whereby" should read --thereby--.
Line 21, "whereby" should read --thereby--.
Line 42, "alcoxy" should read --alkoxy--.

COLUMN 8:

Line 49, "added the" should read --added to the--.
Line 58, "to adjust" should read --adjustment of--.

COLUMN 9:

Line 21, "of type" should be deleted.
Line 22, "of an" should read --of a--.
Line 28, "dihhdrazide" should read --dihydrazide--.
Line 37, "2-phenytlimidazole" should read --2-phenylimidazole--.
Line 39, "Brensted" should read --Brønsted--.
Line 40, "Brensted" should read --Brønsted--.
Line 44, "Brensted" should read --Brønsted--.

UNITED STATES PATENT AND TRADEMARK OFFICE

CERTIFICATE OF CORRECTION

PATENT NO. : 5,953,023

DATED : September 14, 1999

INVENTOR(S) : AKIHIKO SHIMOMURA, ET AL.

It is certified that error appears in the above-identified patent and that said Letters Patent is hereby corrected as shown below:

COLUMN 10:

Line 3, "whereby" should read --thereby--.
Line 48, "NO." should read --No.--.

COLUMN 11:

Line 22, "becomes" should read --comes--.

COLUMN 14:

Line 12, "of" should read --to determine--.

COLUMN 15:

Line 4, "of an" should read --an--.
Line 9, "example" should read --examples--.
Line 21 "The" should read --the--.
Line 52, "test" (second occurrence) should read --tests--.

COLUMN 16:

Line 3, "examinated" should read --examination--.
Line 15, "examinated" should read --examination--.

UNITED STATES PATENT AND TRADEMARK OFFICE

CERTIFICATE OF CORRECTION

PATENT NO. : 5,953,023

DATED : September 14, 1999

INVENTOR(S) : AKIHIKO SHIMOMURA, ET AL.

It is certified that error appears in the above-identified patent and that said Letters Patent is hereby corrected as shown below:

COLUMN 16:

Line 42, "◎:" should read --o:-- and no ¶ indent.
Lines 43 and 44 should be indented.
Line 45, no ¶ indent.
Line 46 should be indented.

COLUMN 17:

Line 23, "of a" should read --of an--.
Line 47, "of a" should read --of an--.
Line 57, "seal" should read --seals--.
Line 63, "belonging" should read --belonging to--.

COLUMN 18:

Line 50, "obtained" should read --obtain--.
Line 62, "was not occurred," should read --did not occur,--.

COLUMN 19:

Line 2, "obtained" should read --obtain--.
Line 22, "seal" should read --seals--.

UNITED STATES PATENT AND TRADEMARK OFFICE

CERTIFICATE OF CORRECTION

PATENT NO. : 5,953,023

DATED : September 14, 1999

INVENTOR(S) : AKIHIKO SHIMOMURA, ET AL. Page 5 of 5

It is certified that error appears in the above-identified patent and that said Letters Patent is hereby corrected as shown below:

COLUMN 20:

Line 48, "Brensted" should read --Brønsted--.
Line 52, "let head" should read --jet head--.

COLUMN 21:

Line 7, "claim 13," should read --claim 12,--.

COLUMN 22:

Line 8, "Brensted" should read --Brønsted--.
Line 11, "claim 13," should read --claim 12,--.

Signed and Sealed this

Thirteenth Day of June, 2000

*Attest:*

Q. TODD DICKINSON

*Attesting Officer*

*Director of Patents and Trademarks*